United States Patent [19]

Feehan

[11] 4,260,014

[45] Apr. 7, 1981

[54] EBULLIENT COOLED POWER DEVICES

[75] Inventor: John D. Feehan, Bethlehem, Pa.

[73] Assignee: International Telephone and Telegraph Corporation, New York, N.Y.

[21] Appl. No.: 28,415

[22] Filed: Apr. 9, 1979

[51] Int. Cl.[3] ..... H01C 23/42

[52] U.S. Cl. ..... 165/105

[58] Field of Search ..... 165/105

[56] References Cited

U.S. PATENT DOCUMENTS

| | | | |
|---|---|---|---|
| 2,083,611 | 6/1937 | Marshall | 165/105 |
| 3,444,419 | 5/1969 | Hansen | 165/105 |
| 3,817,321 | 6/1974 | Von Cube | 165/105 |
| 3,906,261 | 9/1975 | Ogara | 165/105 |
| 4,027,728 | 6/1977 | Kobayashi | 165/105 |

*Primary Examiner*—George E. Lowrance

*Attorney, Agent, or Firm*—John T. O'Halloran

[57] ABSTRACT

An ebullient cooling system employs a thyratron or other power device which is located within a hollow of a housing. The housing contains a liquid which completely surrounds the device. The liquid is of a type which provides high electrical insulation and which boils at a temperature compatible with the desired operating temperature of the thyratron. A heat exchanger is contained in the housing and is located above the liquid level. The heat exchanger is adapted to receive vapors which are produced when the device is operating and serves to condense the vapors back to a liquid to return the same to the reservoir. The power device is thusly cooled by the latent heat of vaporization and by the action of the heat exchanger when condensing the vapors back to a liquid.

1 Claim, 1 Drawing Figure

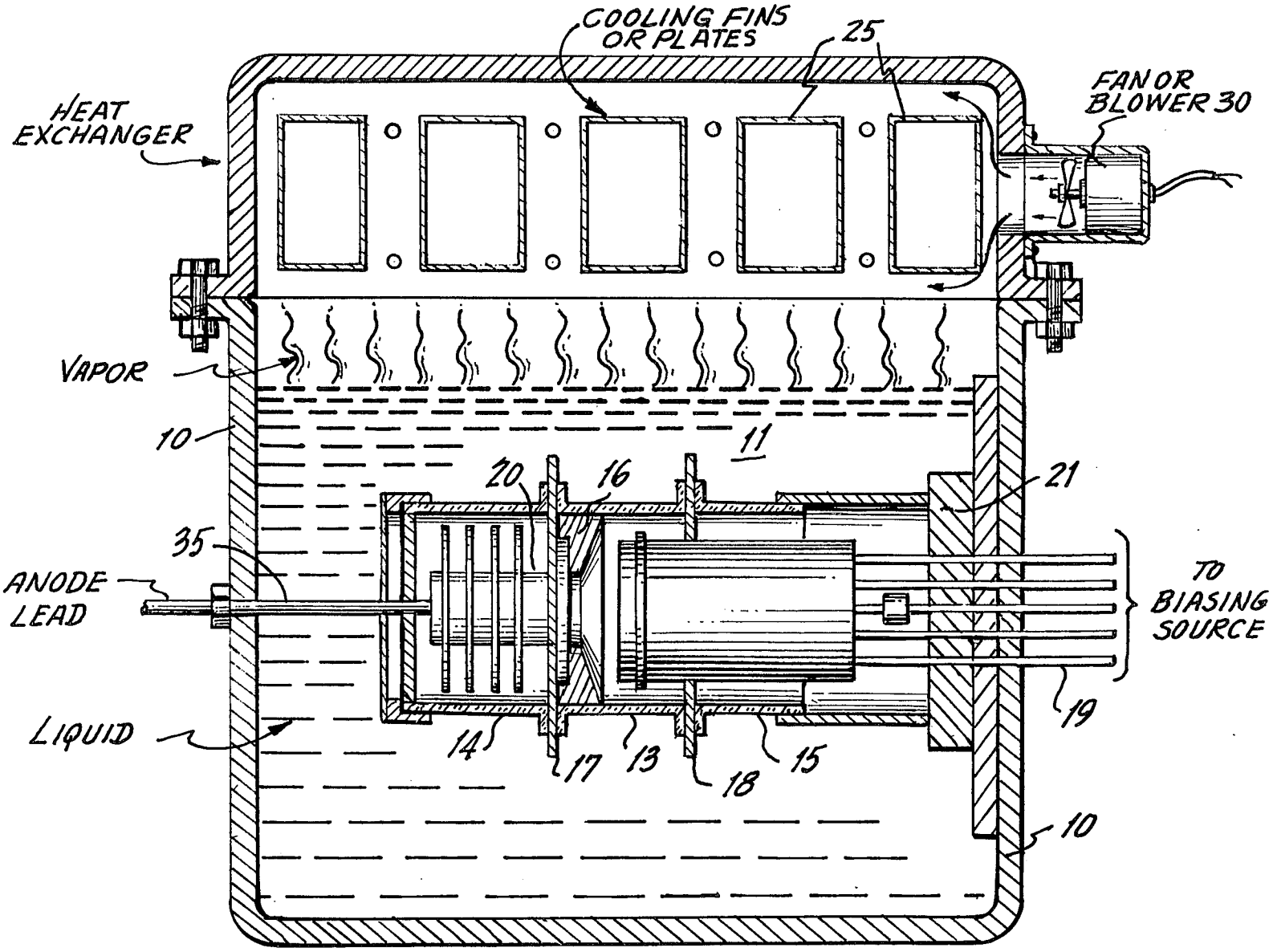
FAN OR BLOWER 30
TO BIASING SOURCE
21
19
10
25
COOLING FINS OR PLATES
11
15
18
13
16
17
20
14
HEAT EXCHANGER
VAPOR
10
35
ANODE LEAD
LIQUID

EBULLIENT COOLED POWER DEVICES

BACKGROUND OF INVENTION

This invention relates to an ebullient cooling system for a power device and more particularly to such a cooling system employed in conjunction with a thyratron.

Essentially, there are a great many high power gas tube devices which are employed in present technology. These devices operate at high voltage and/or high current at relatively high frequency and as such, dissipate a great deal of power. Examples of such devices are gas tubes such as thyratrons and ignitrons. Essentially, if a grid or grids are placed between the anode and cathode in a hot cathode, gas filled rectifier tube, the device is referred to as a thyratron.

There are many suitable examples and explanations of operation of thyratron devices in the prior art and both the operation and the construction of such devices is relatively well known. These devices are used to switch high voltage or high current at relatively high switching rates. Present technology employs the thyratron for switching power in highly sophisticated systems, such as radar equipment, laser technology, isotope separation, fusion and photochemistry.

Basically, modern technology has determined many uses for such devices; which uses are consistent with demands for higher power and higher switching operation. As one can well imagine, there are many problems which limit the performance of existing high power devices, such as thyratrons and various other high power devices.

Paticularly, the problems are inherent with overheating of the device due to the higher power requirements, arcing between elements of the device due to the high voltages, non-uniform heating of the device resulting in stress related mechanical failures, high impedances of the device which result from the larger size necessitated by the high power handling capability and hence, the large size associated with a device capable of handling such large power.

Basically, the design of conventional thyratrons or high power devices is limited in a number of ways by the large ceramics which must be employed to provide voltage insulation between the different elements of the tube. Modern thyratrons employ ceramic sections which serve to insulate the various sections of the thyratron when used in high power applications. The size of these ceramics determine the operating voltage of the device and as above indicated, the higher the requirements, the larger are the ceramics.

In any event, such devices in operation are normally cooled by the use of a fan. This cooling operation presents further problems in that stresses are developed on the device based on the fact that the cooling fan or blower tends to cool one side of the device preferentially and thus, the device develops a temperature gradient which results in mechanical stresses and consequent device failure.

It is therefore an object of the present invention to provide an ebullient cooling system to be employed with a power device such as a thyratron to effectively cool the device.

It is a further object of the present invention to provide an ebullient cooling system operating in conjunction with a thyratron which enables compact construction of a thyratron capable of dissipating large amounts of power at high frequency.

It is a further object of this invention to provide an improved thyratron switching device which will operate at higher power, lower impedance in a smaller package and with greater reliability than prior art devices, all afforded by an ebullient cooling system operated in conjunction with the device.

BRIEF DESCRIPTION OF THE DRAWING

Above-mentioned and other features and objects of this invention will become more apparent by reference to the following description taken in conjunction with the accompanying drawings, in which:

The sole FIGURE is a cross-sectional view taken through an ebullient cooled thyratron device.

It is understood that the construction of the device may be of any suitable configuration such as cylindrical, rectangular and so on.

DESCRIPTION OF THE PREFERRED EMBODIMENT

An ebullient cooled power apparatus, comprising a housing having an internal hollow for accommodating a liquid which when exposed to a predetermined amount of heat will vaporize, a heat exchanger positioned within said housing at one end and located above the level of said liquid and adapted to condense vapors inpinging thereon back to a liquid, a power device located in said housing and positioned to be surrounded by said liquid, means coupled to said housing and said power device adapted to apply an operating potential to said device to cause said device to vaporize said liquid to thereby cool said device by the latent heat of vaporization of said liquid, said heat exchanger condensing said vapor back to a liquid for returning the same to said reservoir by means of gravity.

DETAILED DESCRIPTION OF THE INVENTION

Referring to the sole FIGURE, there is shown a liquid tight housing 10. The housing 10 may be constructed of a metal, ceramic or other suitable material and serves as a liquid reservoir. Located in the hollow of the housing is a thyratron tube or high power device 11. The tube is conventionally inserted into a socket 21 wherein the various elements of the device are made accessible. Suitable seals elements 15, such as a water tight seal, are employed in conjunction with the housing 10 to prevent liquid which is dispersed in the housing from leaking out of the housing during operation. The tube 11 is shown positioned in the housing in a horizontal position to further prevent the fluid from leaking from the housing.

It is understood that while a thyratron device 11 is described, that the invention has applicability to other devices such as ignitrons and so on. As is known in the art, an ignitron must be operated in a vertical position. The technique and structure to be described herein has application for use with such devices and present technology concerning liquid tight seals and so on will permit operation of the device in any desired orientation.

Essentially, the device 11 has an outer wall which consists of sections 12, 13, and 14 which are fabricated from suitable ceramics. These sections form an outer external wall for the thyratron and are used to insulate the various electrodes, such as the cathode, grid and anode of the device for high power and high frequency operation.

Normally, the grid electrode 16 has associated therewith cooling fins, such as 17 and 18 to provide more efficient cooling of the grid structure of such a device. The anode electrode 20 may also have fins associated therewith to further cool the anode during operation. The construction of such a thyratron employing cooling fins and ceramic sections as shown in the FIGURE is well known in the prior art.

The liquid reservoir 10 which contains the thyratron or power device 11 is filled to a suitable level with a liquid 30. The liquid 30, as will be explained, is of a type which provides high electrical insulation and which will boil at a temperature compatible with the desired operating temperatures of the thyratron or power device 11. Examples of suitable liquids will be given at the end of the specification.

Located at the top of the housing 10 is a heat exchanger unit 25. The heat exchanger 25 is of a conventional configuration and may comprise a plurality of metallic fins which are uniformly or otherwise disposed along the length of the heat exchanger. Many configurations for heat exchangers are well known and based on the operation of the device to be described, it is understood that there are many alternate embodiments of heat exchangers which could be employed in conjunction with this invention.

Essentially, the heat exchanger may have an input port as shown in the FIGURE which is coupled to an appropriate blower or fan 31. In this manner, the fins associated with the heat exchanger can be cooled by means of the blower assembly 31 to thus provide an integral unit which can be directly employed by the consumer or the user without requiring the user to supply an external cooling system as is conventional with prior art devices.

It is, of course, understood that the blower 31 may be omitted for certain operating ranges and the heat exchanger 25 would be completely sufficient to accommodate high power operation in such systems, as described.

Referring to the FIGURE, a brief description of the operation of the device will be made. The thyratron is, as indicated, supported within the reservoir housing 10. The thyratron may be supported in the horizontal position by means of a coupling rod 35 and by means of the aforementioned socket 21. The Thyratron II socket is conventionally inserted into a tube socket 21 and power is applied to the various electrodes of the device 19.

As indicated, the device dissipates a great deal of power during operation. The power dissipated by the device causes the liquid, which totally surrounds the device, to boil or to change from the liquid to a vapor state. The vapors are directed upward to the heat exchanger 25. Due to the fact that the heat exchanger is operating at a low temperature based on its large surface area and so on, the vapors condense when they impinge upon the fins or the structure of the heat exchanger. When the liquid boils, the device is cooled by the latent heat of vaporization. The rising vapors are condensed by the heat exchanger and fall back into the reservoir 10 due to gravity. Hence, both the liquid and the device are continuously cooled.

As previously indicated, the heat exchanger may be air or liquid (such as $H_2O$) cooled to further increase the efficiency of operation, but it is understood that even if the heat exchanger is not air cooled, it will still operate to condense the vapors and return the liquid back to the reservoir.

The device thus described is an integral unit capable of continuous operation and enabling one to provide a smaller and more compact package which is capable of operating at a much greater power level than a prior art device of the same volume. Immersion of the power device in the insulating liquid permits the size of the ceramics to be reduced by factors of approximately five or more times. This permits the tube designer greater freedom in the design of internal parameters, and provides more reliable voltage isolation. In reducing the size of the electrode structures in regard to the ceramic parts, the tube will operate at much higher frequencies due to the reduction in both inductance and capacitance associated with the electrode elements. The complete immersion of the device which includes the anode plus the grid cooling fins, provides efficient cooling of the device, thus enabling higer power operation. Since the device is entirely surrounded by the liquid medium, it is uniformly cooled which thus eliminates stresses which are normally developed when such devices are cooled by means of blowers and so on, which tend to cool one side of the device in preference to the other.

Essentially, the entire device is much smaller than a prior art device operating at the same power level and the advantage of both the heat exchanger and the reservoir still result in a lower volume package for a high power device.

While the description has concentrated on the use of a thyratron device 11 as contained in the liquid reservoir, it is understood that any other type of power device can be employed in conjunction with the liquid, the reservoir, and the heat exchanger to provide higher power and higher frequency levels than those permitted by the prior art.

An example of a suitable liquid which can be employed in the reservoir and which will operate according to the above considerations is the fluorocarbon FC-75 or the like.

I claim:

1. An ebuillient cooled power apparatus, comprising:

a relatively vertical housing having an internal hollow for accommodating a fluorocarbon liquid which when exposed to a predetermined amount of heat will vaporize;

a heat exchanger including a plurality of metal fins positioned within said housing at a top end and located above the level of said liquid and adapted to condense vapors impinging thereon back to a liquid, said housing having an aperture in a sidewall adjacent said heat exchanger, a fan coupled to said housing about said aperture to direct air into said heat exchanger for cooling the same, a thyratron electron tube positioned horizontally in said housing and totally immersed within said fluid, said thyratron having a plate, cathode and grid electrode, with said plate electrode coupled to a horizontal supporting rod extending through a sidewall of said housing, a socket member located internally on a sidewall of said housing opposite said sidewall containing said rod, with said grid and cathode electrodes of said thyratron inserted into said socket member to provide said horizontal support for said thyratron;

means coupled to said thyratron for applying operating potential thereto, to cause said device to vaporize said liquid to thereby cool said thyratron by the latent heat of vaporization of said liquid, said heat exchanger operative with said fan for condensing said vapor back to a liquid for returning the same to said housing, whereby during all operating conditions said thyratron will be totally immersed in said fluid and cooled thereby.

* * * * *